US008404912B1

(12) United States Patent
Miller

(10) Patent No.: US 8,404,912 B1
(45) Date of Patent: Mar. 26, 2013

(54) PROCESS FOR MAKING HIGH VI LUBRICATING OILS

(75) Inventor: Stephen Joseph Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/467,567

(22) Filed: May 9, 2012

(51) Int. Cl.
*C10G 47/00* (2006.01)
*C07C 5/13* (2006.01)

(52) U.S. Cl. ..... 585/241; 585/734; 208/107; 208/108; 208/58

(58) Field of Classification Search ..... None
See application file for complete search history.

(56) References Cited

U.S. PATENT DOCUMENTS 3,308,052 A * 3/1967 Ireland et al. ..... 208/27
6,143,940 A 11/2000 Miller et al.
6,150,577 A 11/2000 Miller et al.
6,288,296 B1 9/2001 Miller et al.
6,774,272 B2 8/2004 Miller
6,822,126 B2 11/2004 Miller
2009/0151233 A1 * 6/2009 Miller ..... 44/307
2011/0020190 A1 * 1/2011 Miller ..... 422/187
2012/0184787 A1 * 7/2012 Miller ..... 585/1

FOREIGN PATENT DOCUMENTS

EP 0620264 10/1994

OTHER PUBLICATIONS

S.J. Miller, N. Shah and G.P. Huffman "Conversion of Waste Plastic to Lubricating Base Oil" Energy Fuels 2005, 19, 1580-1586.

* cited by examiner

*Primary Examiner* — Tam M Nguyen
(74) *Attorney, Agent, or Firm* — Terrence Flaherty

(57) ABSTRACT

A process for making a high VI lubricating base oil from a blend of (1) a heavy wax derived from pyrolyzing a plastic feed and (2) a lube oil feedstock is disclosed. The process comprises the steps of hydrocracking the blend and dewaxing at least a portion of the hydrocracked stream under hydroisomerization conditions to produce a lubricating base oil.

18 Claims, No Drawings

PROCESS FOR MAKING HIGH VI LUBRICATING OILS

TECHNICAL FIELD

This disclosure relates to a process for making high viscosity index base oils from a blend of a lube oil feedstock and a heavy wax derived from a pyrolyzed plastic feed. The blend is hydrocracked, dewaxed and, optionally, hydrofinished.

BACKGROUND

Because of environmental concerns, automobile manufacturers and government regulators have introduced new, more stringent performance requirements for lubricants. As a result, the specifications for finished lubricants are requiring products having excellent low temperature properties, high oxidation stability, and low volatility. Currently, only a small fraction of the base oils manufactured today are able to meet these demanding specifications.

Group II+ base oil, though not an official American Petroleum Institute (API) designation, is a term used to describe API Group II stocks of higher viscosity index (110-119) and lower volatility than comparable Group II stocks.

Due to their low viscosity and low volatility, API Group III base oils have become the base stocks of choice for the next generation of lubricant compositions. This in turn has lead to a greater demand for Group III base oils. However, producing Group III base oils can be difficult requiring the use of special high viscosity index gas oils which can be higher in cost than gas oils used to make Group II base oils. In addition, the production of Group III base oils can also involve hydrocracking gas oils at higher severity in order to get the viscosity index to at least 120 which can result in lower yield, downgrading potential base oil to lower valued diesel and other light products, and shortening the hydrocracker catalyst life.

It would be advantageous if a refiner could simply switch from Group II base oil production to Group II+ or Group III base oil production by adding a minor amount of a different second feed to a lube oil feedstock ahead of a hydrocracking unit in order to boost the viscosity index for as long as the Group II+ or Group III base oil production was required. It would also be advantageous if the second feed were low in cost and had additional benefits, such as reduction of environmental waste.

One potential low cost feed is waste plastics. Transforming waste plastic material and particularly polyethylene into useful products presents a unique opportunity to address a growing environmental problem.

Various processes for converting waste plastic into lubricating base oils have been developed. For example, U.S. Pat. No. 6,150,577 discloses a process wherein waste plastic is fed to a pyrolysis reactor. The pyrolysis effluent is separated into at least a heavy fraction which is hydrotreated and hydroisomerization dewaxed to form a high viscosity index (VI) lubricating base oil. In U.S. Pat. No. 6,288,296, waste plastic is fed to a pyrolysis reactor. The middle fraction from the pyrolysis effluent is dimerized and subsequently fed to an isomerization dewaxing zone to produce a high VI lubricating base oil. In U.S. Pat. No. 6,774,272 a blend of waste plastic and a Fischer-Tropsch waxy fraction is fed to a pyrolysis reactor. The heavy fraction from the pyrolysis effluent is hydrotreated and hydroisomerization dewaxed to produce a high VI lubricating base oil. U.S. Pat. No. 6,822,126 discloses a process wherein a waste plastic feed is continuously passed to a pyrolysis reactor. The reactor effluent is then fed to a hydroisomerization dewaxing unit and fractionated to recover lube oil stocks. U.S. patent application Ser. No. 13/008,153 discloses a process wherein wax derived from a pyrolysis of a plastic feed is added to a base oil stream going to a hydroisomerization unit to increase the VI of the base oil, raising it to a higher value product. Because of the sensitivity of the hydroisomerization dewaxing catalyst to poisoning by sulfur and nitrogen impurities, the waxy feed from the pyrolyzer either has to be very low in sulfur and nitrogen to start or the waxy feed has to be hydrotreated prior to hydroisomerization dewaxing in order to reduce sulfur and nitrogen to very low levels.

Accordingly, it would be desirable to have a process for producing high VI lube oils whereby the waxy product from a pyrolyzer would not have to be hydrotreated in a separate step and the plastic feed would not have to be segregated to keep sulfur and nitrogen impurities low.

SUMMARY

In one aspect, there is provided a process for making a high VI lubricating base oil, comprising hydrocracking a blend, comprising (1) a heavy wax derived from pyrolyzing a plastic feed and (2) a lube oil feedstock, in a lube hydrocracking zone in the presence of a hydrocracking catalyst and hydrogen under lube hydrocracking conditions to produce a hydrocracked stream; and dewaxing at least a portion of the hydrocracked stream in a hydroisomerization zone in the presence of a hydroisomerization catalyst and hydrogen under hydroisomerization conditions to produce a base oil.

The process disclosed herein provides several advantages over previously known techniques. Instead of adding the heavy wax from the pyrolyzer to the isomerization unit, it is added to the lube hydrocracker ahead of the isomerization step. This gives a large increase in the VI of the base oil. Because the hydrocracking catalyst and process can handle a high sulfur and nitrogen level in the feed, the level of these impurities in the heavy wax is not an issue. By not having to hydrotreat the heavy wax separately, this step can be eliminated. It also gives the supplier of the heavy wax somewhat more flexibility in the choice of plastic for that process, enabling the use of plastic with higher nitrogen, sulfur and oxygen levels than otherwise. In addition, it was conventionally thought that the heavy wax could not be added to the hydrocracker since it was assumed that the heavy wax, because of its substantial olefinic content, would crack to light product out of the base oil range. Surprisingly, the hydrocracked heavy wax concentrates in the uncracked 650° F.+ bottoms fraction rather than cracking to light products.

DETAILED DESCRIPTION

The following terms will be used throughout the specification and will have the following meanings unless otherwise indicated.

The term "heavy wax derived from pyrolyzing a plastic feed" refers to a lubricating oil boiling range material (650° F.+, 343° C.+, boiling point) which originates from or is produced at some stage by a process in which a plastic feed is pyrolyzed. The plastic feed for the pyrolysis process can come from a wide variety of sources, including waste plastic, virgin plastic, and mixtures thereof.

The terms "waste plastic" or "waste polyethylene" refer to plastics or polyethylene that have been subject to use and are considered garbage, refuse, or material for recycling.

The terms "virgin plastic" or "virgin polyethylene" refer to plastics or polyethylene that are fresh and/or newly made and have not been subject to use.

The term "Group II base oil" refers to a base oil which contains greater than or equal to 90% saturates and less than or equal to 0.03% sulfur and has a viscosity index greater than or equal to 80 and less than 120 using the ASTM methods specified in Table E-1 of American Petroleum Institute Publication 1509.

The term "Group II+ base oil" refers to a Group II base oil having a viscosity index greater than or equal to 110 and less than 120.

The term "Group III base oil" refers to a base oil which contains greater than or equal to 90% saturates and less than or equal to 0.03% sulfur and has a viscosity index greater than or equal to 120 using the ASTM methods specified in Table E-1 of American Petroleum Institute Publication 1509.

The term "hydrotreating" refers to a catalytic process, usually carried out in the presence of free hydrogen, in which the primary purpose when used to process hydrocarbon feedstocks is the removal of various metal impurities (e.g., arsenic), heteroatoms (e.g., sulfur, nitrogen and oxygen), and aromatics from the feedstock. Generally, in hydrotreating operations cracking of the hydrocarbon molecules (i.e., breaking the larger hydrocarbon molecules into smaller hydrocarbon molecules) is minimized. For the purpose of this discussion, the term hydrotreating refers to a hydroprocessing operation in which the conversion is 20% or less, where the extent of "conversion" relates to the percentage of the feed boiling above a reference temperature (e.g., 700° F.) which is converted to products boiling below the reference temperature.

The term "hydrocracking" refers to a catalytic process, usually carried out in the presence of free hydrogen, in which the cracking of the larger hydrocarbon molecules into smaller hydrocarbon molecules is the primary purpose of the operation. In contrast to hydrotreating, the conversion rate for hydrocracking, for the purpose of this disclosure, is defined as more than 20%.

The term "aromatics" means an unsaturated, cyclic and planar hydrocarbon group with an uninterrupted cloud of electrons containing an odd number of pairs of it electrons. Any molecule that contains such a group is considered aromatic.

The term "oxygenates" means a hydrocarbon containing oxygen, i.e., an oxygenated hydrocarbon. Oxygenates include alcohols, ethers, carboxylic acids, esters, ketones, and aldehydes, and the like.

When used herein, the Periodic Table of the Elements refers to the version published by CRC Press in the *CRC Handbook of Chemistry and Physics,* 88th Edition (2007-2008). The names for groups of the elements in the Periodic Table are given here in the Chemical Abstracts Service (CAS) notation.

Lube Oil Feedstock

The present process can employ a wide variety of lube oil feedstocks from many different sources, including, but not limited to, crude oil, virgin petroleum fractions, recycle petroleum fractions, shale oil, liquefied coal, tar sand oil, petroleum distillates, solvent-deasphalted petroleum residua, coal tar distillates, and combinations thereof. Other feedstocks that can be used include synthetic feeds such as synthetic paraffins derived from normal alphaolefins and those derived from Fischer-Tropsch processes. Other suitable feedstocks include those heavy distillates normally defined as heavy straight-run gas oils and heavy cracked cycle oils, as well as conventional fluid catalytic cracking feed and portions thereof. In general, the feed can be any carbon-containing feedstock susceptible to hydroprocessing catalytic reactions, particularly hydrocracking. The sulfur, nitrogen and saturate contents of these feeds will vary depending on a number of factors.

A suitable lube oil feedstock is a vacuum gas oil boiling in a temperature range above about 450° F. (232° C.) and more typically within the temperature range of 550° F. to 1100° F. (288° C. to 593° C.). In some embodiments, at least 50 wt. % of the lube oil feedstock boils above 550° F. (288° C.).

Heavy Wax Derived from a Pyrolyzed Plastic Feed

Heavy wax is a valuable material for the production of lubricating base oils. Heavy waxes can be prepared by pyrolyzing a plastic feed by means well known to those of skill in the art and are described, for example, in U.S. Pat. No. 6,143,940. The pyrolysis effluent is typically hydrotreated to remove sulfur and nitrogen impurities to produce a high quality heavy wax.

The pyrolysis reactor can employ a variety of plastic feeds. The plastic feed can be selected from the group consisting of waste plastic, virgin plastic, and mixtures thereof. Waste plastic is an attractive feedstock since it is readily available and inexpensive. Its use also addresses a growing environmental problem. However, it is not necessary to utilize waste plastic. As such, the plastic feed can be composed entirely of virgin plastic.

The plastic feed can also contain polyethylene. The plastics feed can comprise at least 50 wt. % polyethylene (e.g., at least 80 wt. % polyethylene). If the plastics feed contains polyethylene, the polyethylene can be selected from the group consisting of waste polyethylene, virgin polyethylene, and mixtures thereof. Furthermore, if the plastics feed contains polyethylene, the polyethylene can be selected from the group consisting of high-density polyethylene (HDPE), low-density polyethylene (LDPE), and mixtures thereof.

The pyrolysis zone effluent typically contains a broad boiling point range of materials. The pyrolysis zone effluent (liquid portion) is very waxy and has a high pour point. It comprises n-paraffins and some olefins. The effluent stream can be fractionated by conventional means into typically at least three fractions, a light, middle, and heavy fraction. The light fraction (e.g., 350° F.−, 177° C.−, boiling point) contains gasoline range material and gases. The middle fraction (e.g., 350° F. to 650° F., 177° C. to 343° C., boiling point) is typically a middle distillate range material. The heavy fraction (e.g., 650° F.+; 343° C.+, boiling point) is a lubricating oil range material. All fractions contain n-paraffins and olefins.

The heavy wax contains n-paraffins and olefins. In some embodiments, the heavy wax comprises at least 30 wt. % n-paraffins (e.g., at least 40 wt. %, at least 50 wt. %, at least 60 wt. %, at least 70 wt. %, at least 80 wt. % or at least 90 wt. % n-paraffins). In some embodiments, the heavy wax comprises at least 5 wt. % 1-olefins (e.g., at least 10 wt. %, at least 15 wt. %, or at least 20 wt. %, or at least 25 wt. % 1-olefins).

The heavy wax can also contain impurities such as sulfur, nitrogen and aromatics. The aromatics content of the heavy wax is generally less than 5 wt. % (e.g., less than 3 wt. %, less than 1 wt. %, or less than 0.5 wt. %). If present, oxygenates will generally make up less than 2 wt. % of the heavy wax (e.g., less than 1 wt. %, less than 0.5 wt. %, or less than 0.1 wt % of the heavy wax).

Blends

The lube oil feedstock and the heavy wax are blended by means well known in the art, including, for example, heating the lube oil feedstock or the heavy wax or dissolving the wax in a solvent prior to blending. The heavy wax can be added to the lube oil feedstock before the blend enters the hydrocracker. Alternatively, the heavy wax and the lube oil feedstock can be passed to the hydrocracker in separate streams to form a blend.

Typical blends comprise from 10 to 90 wt. % of the heavy wax and from 90 to 10 wt. % of the lube oil feedstock, based on the total weight of the blend. In some embodiments, blends can comprise from 10 to 50 wt. % of the heavy wax and from 90 to 50 wt. % of the lube oil feedstock (e.g., from 15 to 50 wt. % of the heavy wax and from 85 to 50 wt. % of the lube oil feedstock, from 20 to 50 wt. % of the heavy wax and from 80 to 50 wt. % of the lube oil feedstock, or from 25 to 50 wt. % of the heavy wax and from 75 to 50 wt. % of the lube oil feedstock). Higher percentages in the blend of the heavy wax can produce higher viscosity index base oils.

It is usually desirable to maintain as low a cloud point as possible for the lubricating base oil. If the heavy wax in the blend has too much wax boiling above 1000° F. (538° C.), then the base oil product, after hydroisomerization dewaxing, will have a high cloud point which is difficult to reduce without extra conversion. In one embodiment, less than 10 wt. % of the heavy wax boils above 1000° F. (538° C.). In another embodiment, less than 5 wt. % of the heavy wax boils above 1000° F. (538° C.).

Hydrocracking

The hydrocracking reaction zone is maintained at conditions sufficient to effect a boiling range conversion of the feed to the hydrocracking reaction zone, so that the liquid hydrocrackate recovered from the hydrocracking reaction zone has a normal boiling point range below the boiling point range of the feed. The hydrocracking step reduces the size of the hydrocarbon molecules, hydrogenates olefin bonds, hydrogenates aromatics, and removes traces of heteroatoms resulting in an improvement in base oil product quality.

The conditions of the hydrocracking reaction zone can vary according to the nature of the feed, the intended quality of the products, and the particular facilities of each refinery. Hydrocracking reaction conditions include, for example, a temperature of from 450° F. to 900° F. (232° C. to 482° C.), e.g., from 650° F. to 850° F. (343° C. to 454° C.); a pressure of from 500 psig to 5000 psig (3.5 MPa to 34.5 MPa gauge), e.g., from 1500 psig to 3500 psig (10.4 MPa to 24.2 MPa gauge); a liquid reactant feed rate, in terms of liquid hourly space velocity (LHSV) of from 0.1 $h^{-1}$ to 15 $h^{-1}$ (v/v), e.g., from 0.25 $h^{-1}$ to 2.5 $h^{-1}$; and a hydrogen feed rate, in terms of $H_2$/hydrocarbon ratio, of from 500 SCF/bbl to 5000 SCF/bbl (89 to 890 $m^3$ $H_2/m^3$ feed) of liquid hydrocarbon feed. The hydrocracked stream can then separated into various boiling range fractions. The separation is typically conducted by fractional distillation preceded by one or more vapor-liquid separators to remove hydrogen and/or other tail gases.

The hydrocracking reaction zone that contains the hydrocracking catalyst can be contained within a single reactor vessel, or it can be contained in two or more reactor vessels, connected together in fluid communication in a serial arrangement. In some embodiments, hydrogen and the feed are provided to the hydrocracking reaction zone in combination. Additional hydrogen can be provided at various locations along the length of the reaction zone to maintain an adequate hydrogen supply to the zone. Furthermore, relatively cool hydrogen added along the length of the reactor can serve to absorb some of the heat energy within the zone, and help to maintain a relatively constant temperature profile during the exothermic reactions occurring in the reaction zone.

Catalysts within the hydrocracking reaction zone can be of a single type. In some embodiments, multiple catalyst types can be blended in the reaction zone, or they can be layered in separate catalyst layers to provide a specific catalytic function that provides improved operation or improved product properties. Layered catalyst systems are taught, for example, in U.S. Pat. Nos. 4,990,243 and 5,071,805. The catalyst can be present in the reaction zone in a fixed bed configuration, with the feed passing either upward or downward through the zone. In some embodiments, the feed passes co-currently with the hydrogen feed within the zone. In other embodiments, the feed passes countercurrent to the hydrogen feed within the zone.

The hydrocracking catalyst generally comprises a cracking component, a hydrogenation component and a binder. Such catalysts are well known in the art. The cracking component can include an amorphous silica/alumina phase and/or a zeolite, such as a Y-type or USY zeolite. If present, the zeolite is at least about 1% by weight based on the total weight of the catalyst. A zeolite-containing hydrocracking catalyst generally contains in the range of from 1 wt. % to 99 wt. % zeolite (e.g., from 2 wt. % to 70 wt. % zeolite). Actual zeolite amounts will, of course, be adjusted to meet catalytic performance requirements. The binder is generally silica or alumina. The hydrogenation component will be a Group VI, Group VII, or Group VIII metal or oxides or sulfides thereof, usually one or more of molybdenum, tungsten, cobalt, or nickel, or the sulfides or oxides thereof. If present in the catalyst, these hydrogenation components generally make up from 5% to 40% by weight of the catalyst. Alternatively, platinum group metals, especially platinum and/or palladium, can be present as the hydrogenation component, either alone or in combination with the base metal hydrogenation components molybdenum, tungsten, cobalt, or nickel. If present, the platinum group metals will generally make up from 0.1% to 2% by weight of the catalyst.

Catalysts suitable for hydrocracking are designed with a relatively weaker hydrogenation function and a relatively stronger cracking function than catalysts suitable for hydrotreating. The primary difference between hydrocracking catalysts and hydrotreating catalysts is the presence of a cracking component in the hydrocracking catalyst. The catalysts will both otherwise comprise hydrogenation components (metals) and inorganic oxide support components.

The concentration of sulfur in the feed for hydroisomerization dewaxing should be less than 100 ppm (e.g., less than 50 ppm or less than 20 ppm). The concentration of nitrogen in the feed for hydroisomerization dewaxing should be less than 50 ppm (e.g., less than 30 ppm or less than 10 ppm).

Hydroisomerization Dewaxing

Hydroisomerization dewaxing is achieved by contacting a feed with a hydroisomerization catalyst in an isomerization zone under hydroisomerizing conditions. The hydroisomerization catalyst generally comprises a shape selective intermediate pore size molecular sieve, a noble metal hydrogenation component, and a refractory oxide support. The shape selective intermediate pore size molecular sieve is typically selected from the group consisting of SAPO-11, SAPO-31, SAPO-41, SM-3, SM-7, ZSM-22, ZSM-23, ZSM-35, ZSM-48, ZSM-57, SSZ-32, SSZ-32X, metal modified SSZ-32X, offretite, ferrierite, and combinations thereof. SAPO-11, SM-3, SM-7, SSZ-32, ZSM-23, and combinations thereof are often used. The noble metal hydrogenation component can be platinum, palladium, or combinations thereof.

The hydroisomerizing conditions depend on the feed used, the hydroisomerization catalyst used, whether or not the catalyst is sulfided, the desired yield, and the desired properties of the lubricating base oil. Useful hydroisomerizing conditions include a temperature of from 500° F. to 775° F. (260° C. to 413° C.); a pressure of from 15 psig to 3000 psig (0.10 MPa to 20.68 MPa gauge); a LHSV of from 0.25 $h^{-1}$ to 20 $h^{-1}$; and a hydrogen to feed ratio of from 2000 SCF/bbl to 30,000 SCF/bbl (356 to 5340 $m^3$ $H_2/m^3$ feed). Generally, hydrogen will be separated from the product and recycled to the isomerization zone.

A general description of suitable hydroisomerization dewaxing processes can be found in U.S. Pat. Nos. 5,135,638; 5,282,958; and 7,282,134.

Hydrofinishing

The product from the hydroisomerization step can optionally be hydrofinished. Hydrofinishing is intended to improve the oxidation stability, UV stability, and appearance of the product by removing aromatics, olefins, color bodies, and solvents. Hydrofinishing is typically conducted at a temperature of from 300° F. to 600° F. (149° C. to 316° C.); a pressure of from 400 psig to 3000 psig (2.76 MPa to 20.68 MPa gauge); a LHSV of from 0.1 $h^{-1}$ to 20 $h^{-1}$, and a hydrogen recycle rate of from 400 SCF/bbl to 1500 SCF/bbl (71 to 267 $m^3$ $H_2/m^3$ feed). The hydrogenation catalyst employed must be active enough not only to hydrogenate the olefins, diolefins and color bodies within the lube oil fractions, but also to reduce the aromatic content (color bodies). The hydrofinishing step is beneficial in preparing an acceptably stable lubricating oil. Suitable hydrogenation catalysts include conventional metallic hydrogenation catalysts, particularly the Group VIII metals such as cobalt, nickel, palladium and platinum. The metals are typically associated with carriers such as bauxite, alumina, silica gel, silica-alumina composites, and crystalline aluminosilicate zeolites. Palladium is a particularly useful hydrogenation metal. If desired, non-noble Group VIII metals can be used with molybdates. Metal oxides or sulfides can be used. Suitable catalysts are disclosed in U.S. Pat. Nos. 3,852,207; 3,904,513; 4,157,294; and 4,673,487.

Additionally, U.S. Pat. No. 6,337,010 discloses a process scheme for producing lubricating base oil with low pressure dewaxing and high pressure hydrofinishing and discloses operating conditions for lube hydrocracking, isomerization and hydrofinishing that can be useful herein.

Lubricating Base Oil Product

The lubricating base oil prepared according to the process described herein has a kinematic viscosity at 100° C. of at least 3 $mm^2/s$. Typically, the kinematic viscosity at 100° C. is 8 $mm^2/s$ or less (e.g., from 3 $mm^2/s$ to 7 $mm^2/s$). The lubricating base oil has a pour point of −5° C. or below (e.g., −10° C. or below, or −15° C. or below). The VI is usually at least 100 (e.g., at least 110, at least 115 or at least 120). In one embodiment, the VI of the lubricating base oil product is from 110 to 119. In one embodiment, the lubricating base oil has a kinematic viscosity at 100° C. of from 3 $mm^2/s$ to 7 $mm^2/s$, a pour point of −15° C. or less, and a VI of at least 110. The cloud point of the lubricating base oil is usually 0° C. or below.

The properties of the lubricating base oils prepared using the process described herein are achieved by blending the lube oil feedstock with the minimum amount of the heavy wax necessary to meet the desired specifications for the product.

In one embodiment, the lubricating base oil is a Group II+ base oil. In another embodiment, the lubricating base oil is a Group III base oil.

EXAMPLES

The following illustrative examples are intended to be non-limiting.

Example 1

15 wt. % of a 650° F.+ wax (mostly 650° F. to 1000° F.) derived from pyrolyzed plastic was added to a lube hydrocracker feed. The blend was hydrocracked in the presence of a commercial NiMo hydrocracking catalyst. Reactor conditions included a reaction temperature of 720/732° F., a total reaction pressure of 2100 psig, a LHSV feed rate of 2 $h^{-1}$, and a 3700 SCF/bbl once-through $H_2$ rate. The VI of the 650° F.+ hydrocracked bottoms increased from about 120 to about 135 at 40% 700° F.+ conversion, where 700° F.+ conversion is defined as:

$$[(\text{Wt. \% 700° F.+ (feed)} - \text{Wt. \% 700° F.+ (product)})/\text{Wt. \% 700° F.+ (feed)}]\times 100$$

With a VI of 135 in the feed going to the hydroisomerization dewaxing unit, the product from that unit will now have a VI in the Group II+ range (110 to 119) when the pour point is reduced to −15° C. to −25° C.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

Unless otherwise specified, the recitation of a genus of elements, materials or other components, from which an individual component or mixture of components can be selected, is intended to include all possible sub-generic combinations of the listed components and mixtures thereof.

The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

The invention claimed is:

1. A process for making a high VI lubricating base oil, comprising:

a) hydrocracking a blend, comprising (1) a heavy wax derived from pyrolyzing a plastic feed and (2) a lube oil feedstock, in a lube hydrocracking zone in the presence of a hydrocracking catalyst and hydrogen under lube hydrocracking conditions to produce a hydrocracked stream; and b) dewaxing at least a portion of the hydrocracked stream in a hydroisomerization zone in the presence of a hydroisomerization catalyst and hydrogen under hydroisomerization conditions to produce a base oil.

2. The process of claim 1, wherein the blend comprises from 10 to 90 wt. % of the heavy wax and from 90 to 10 wt. % of the lube oil feedstock, based on the total weight of the blend.

3. The process of claim 1, wherein less than 10 wt. % of the heavy wax boils above 1000° F. (538° C.).

4. The process of claim 1, wherein less than 5 wt. % of the heavy wax boils above 1000° F. (538° C.).

5. The process of claim 1, wherein the heavy wax comprises at least 30 wt. % n-paraffins.

6. The process of claim 1, wherein the heavy wax comprises at least 5 wt. % 1-olefins.

7. The process of claim 1, wherein the heavy wax comprises less than 5 wt. % aromatics.

8. The process of claim 7, wherein the heavy wax comprises less than 3 wt. % aromatics.

9. The process of claim 1, wherein the heavy wax comprises less than 2 wt. % oxygenates.

10. The process of claim 9, wherein the heavy wax comprises less than 1 wt. % oxygenates.

11. The process of claim 1, wherein the plastic feed comprises at least 80 wt. % polyethylene.

12. The process of claim 11, wherein the polyethylene is selected from the group consisting of waste polyethylene, virgin polyethylene, and mixtures thereof.

13. The process of claim 11, wherein the polyethylene is selected from the group consisting of high-density polyethylene, low-density polyethylene, and mixtures thereof.

14. The process of claim 1, wherein the lube oil feedstock is a vacuum gas oil.

15. The process of claim 1, wherein the base oil has a kinematic viscosity at 100° C. of from 3 to 7 $mm^2/s$.

16. The process of claim 1, wherein the base oil is a Group II+ base oil.

17. The process of claim 1, wherein the base oil is a Group III base oil.

18. The process of claim 1, further comprising stabilizing the base oil in a hydrofinishing zone in the presence of a hydrofinishing catalyst and hydrogen under hydrofinishing conditions.

* * * * *